US007987558B2

(12) United States Patent
Beckmann et al.

(10) Patent No.: US 7,987,558 B2
(45) Date of Patent: Aug. 2, 2011

(54) MULTILINK HINGE

(75) Inventors: Wolfgang Beckmann, Hüllhorst (DE); Cord Rommelmann, Dörentrup (DE); Andreas Kleemann, Kalletal (DE); Eduard Thielmann, Lage (DE); Dieter Waltemate, Hüllhorst (DE)

(73) Assignee: Hettich-Oni GmbH & Co., Vlotho Nordrhein-Westfalen (DE)

( * ) Notice: Subject to any disclaimer, the term of this patent is extended or adjusted under 35 U.S.C. 154(b) by 645 days.

(21) Appl. No.: 11/814,940

(22) PCT Filed: Jan. 30, 2006

(86) PCT No.: PCT/EP2006/050531

§ 371 (c)(1),
(2), (4) Date: Apr. 24, 2008

(87) PCT Pub. No.: WO2006/082175

PCT Pub. Date: Aug. 10, 2006

(65) Prior Publication Data

US 2008/0276422 A1 Nov. 13, 2008

(30) Foreign Application Priority Data

Feb. 2, 2005 (DE) ..... 10 2005 004 957

(51) Int. Cl.
*E05D 3/06* (2006.01)

(52) U.S. Cl. ..... 16/366; 16/251; 16/387

(58) Field of Classification Search ..... 16/281–282, 16/284–285, 287–288, 295–296, 301–303, 16/361, 366, 368–370, 375
See application file for complete search history.

(56) References Cited

U.S. PATENT DOCUMENTS

| | | | | | |
|---|---|---|---|---|---|
| 3,626,548 | A | * | 12/1971 | Grunery | 16/358 |
| 3,673,635 | A | * | 7/1972 | Cencioni | 16/358 |
| 4,388,745 | A | * | 6/1983 | Schneider et al. | 16/288 |
| 4,727,622 | A | * | 3/1988 | Tsuneki | 16/368 |
| 4,827,569 | A | * | 5/1989 | Mertes | 16/288 |
| 5,035,026 | A | * | 7/1991 | Carlo et al. | 16/288 |
| 5,058,238 | A | * | 10/1991 | Lautenschlager | 16/278 |
| 5,062,182 | A | * | 11/1991 | Griffiths et al. | 16/368 |
| 5,450,655 | A | * | 9/1995 | Ferrari et al. | 16/370 |
| 5,791,016 | A | | 8/1998 | Lenz | |
| 6,141,832 | A | * | 11/2000 | Salice | 16/366 |

(Continued)

FOREIGN PATENT DOCUMENTS

| | | | |
|---|---|---|---|
| DE | 3028266 | A1 | 2/1982 |
| GB | 2049800 | A | 12/1980 |

*Primary Examiner* — Victor Batson
*Assistant Examiner* — Roberta S Delisle
(74) *Attorney, Agent, or Firm* — Barnes & Thornburg LLP

(57) ABSTRACT

A hinge includes a first mounting part defining first and second ends, a second mounting part defining third and fourth ends, a first articulated lever defining fifth and sixth ends, a second articulated lever defining seventh and eighth ends, a third articulated lever defining ninth and tenth ends, and a fourth articulated lever defining eleventh and twelfth ends. The fifth end pivotally connects between the first end and the second end. The sixth end pivotally connects to the tenth end. The ninth end pivotally connects to the fourth end. The third end pivotally connects to the eleventh end. The second end pivotally connects to the seventh end. The eighth end pivotally connects between the ninth end and the tenth end. The twelfth end pivotally connects between the seventh end and the eighth end. A protective plate covers at least a portion of the plates and levers.

2 Claims, 4 Drawing Sheets

Figure 1:
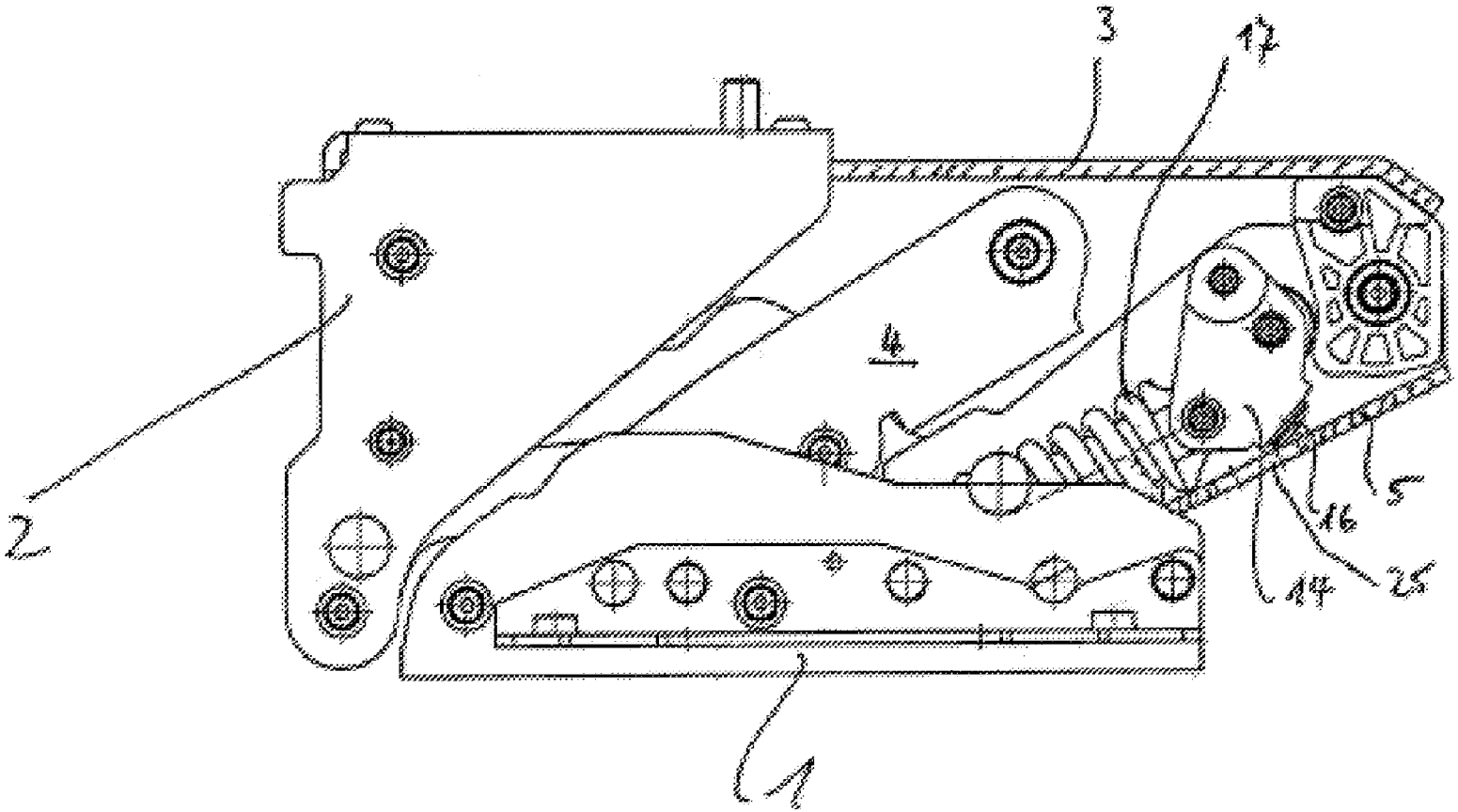

U.S. PATENT DOCUMENTS 6,243,918 B1 * 6/2001 Zetti ..... 16/298
6,308,376 B1 * 10/2001 Koshikawa ..... 16/250
6,374,459 B1 * 4/2002 Zetti ..... 16/366
2001/0025398 A1 * 10/2001 Zetti ..... 16/370

* cited by examiner

MULTILINK HINGE

The invention relates to a multilink hinge, especially for refrigerator doors, comprised of articulated levers connected to one another in a scissor-type manner.

Hinges of this type are widely known in the prior art, for example from the patent GB 1 066 710 or U.S. Pat. No. 5,035,026.

However the known hinges entail various disadvantages.

Because especially with refrigerators, due to their thermal insulation, very thick door components are used, the hinges must have relatively long articulated levers in order to achieve the desired radius—away from the unit toward the front. This results in the creation of differently sized gaps between the articulated levers, depending upon the open position, said gaps increasing or decreasing in size with the movement of the door. If they decrease in size, injury could result if, for example, a child were to stick a finger in the gap. The articulated levers that are interconnected in a scissor-type manner would then act as cutting shears.

It is therefore the object of the invention to eliminate this defect.

This object is achieved with a multilink hinge, especially for refrigerator doors, comprised of articulated levers connected to one another in a scissor-type manner, in which the parts that make up the multilink hinge are covered by at least one lateral protective plate, to the extent that they assume different positions in relation to one another based upon the open position of the hinge.

This practically eliminates the danger of injury caused by clamping and cutting between the articulated levers.

A further disadvantage of the known hinges consists in the fact that, if they are equipped with a spring-mounted closing device, which is especially advantageous in the case of a refrigerator, the closing force cannot be adjusted over a larger area, nor can the swiveling range in which the closing force is to be effective be adjusted.

It is also the object of the invention to overcome the aforementioned drawback.

This object is achieved with a multilink hinge, especially for refrigerator doors, comprised of articulated levers connected to one another in a scissor-type manner, wherein one of the articulated levers is equipped with a radial cam, and said radial cam interacts with a roller disposed on a rocker arm, with said rocker arm pressing the roller against the radial cam under the force of the spring, thereby forcing the multilink hinge forced into the closed and/or open position, in that the rocker arm is equipped with an adjusting screw, which strikes the same articulated lever on which the rocker arm is disposed.

With the adjusting screw, the closing force of the multilink hinge can be influenced, as can the swiveling range within which said closing force is to be effective.

Advantageously, with a multilink hinge of the type discussed here, the two concepts can also be linked to one another, in other words a multilink hinge with parts that are covered by at least one protective plate can advantageously be combined with the concept of the adjustable closing device.

Further characterizing features of the invention are the object of the dependent claims.

In the figures and in the remainder of the description, exemplary embodiments of the invention are described.

The figures show:

FIG. 1 a lateral view of the hinge in cross-section.

Figure 2:
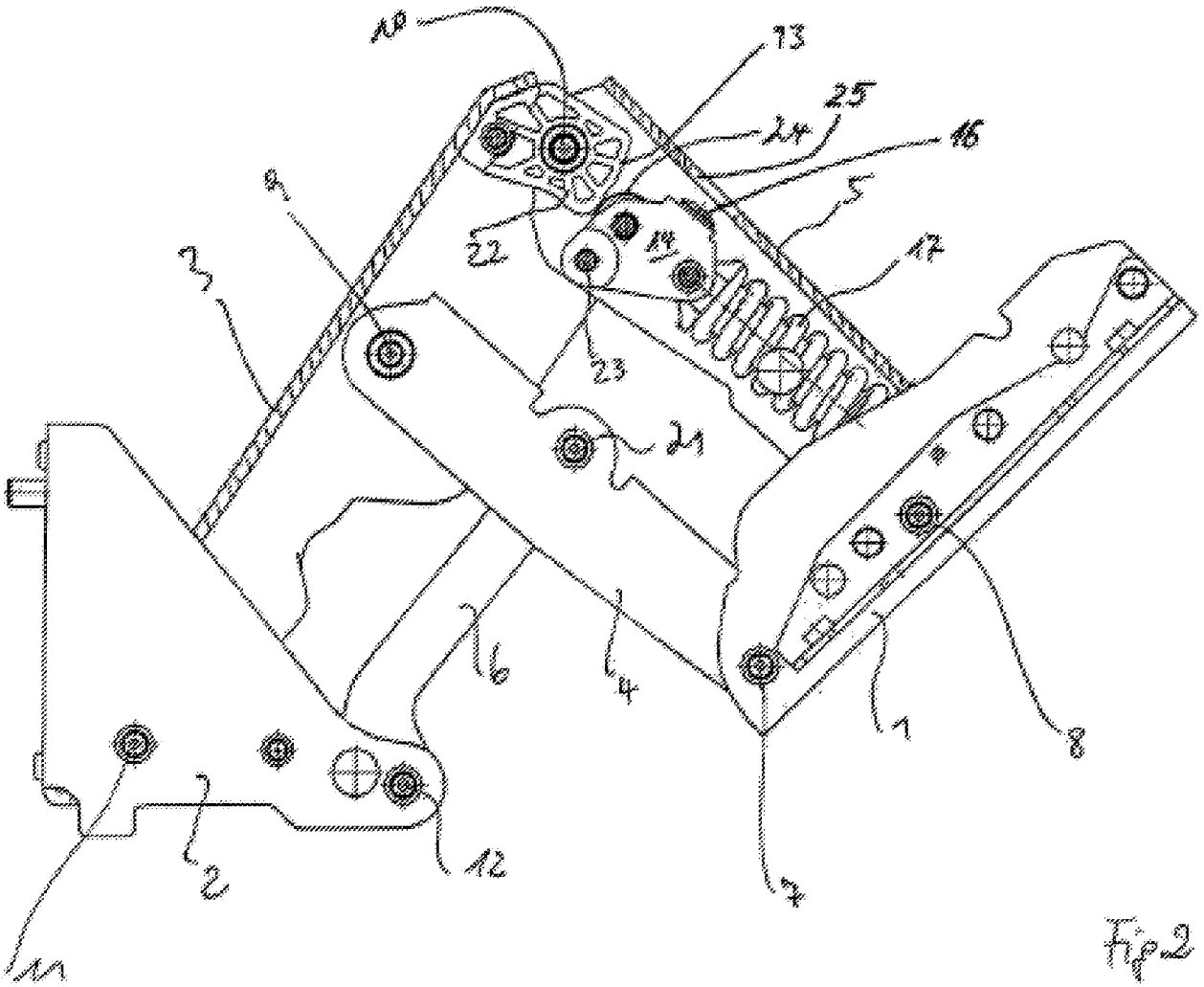

FIG. 2 a hinge according to FIG. 1, partially opened.

Figure 3:
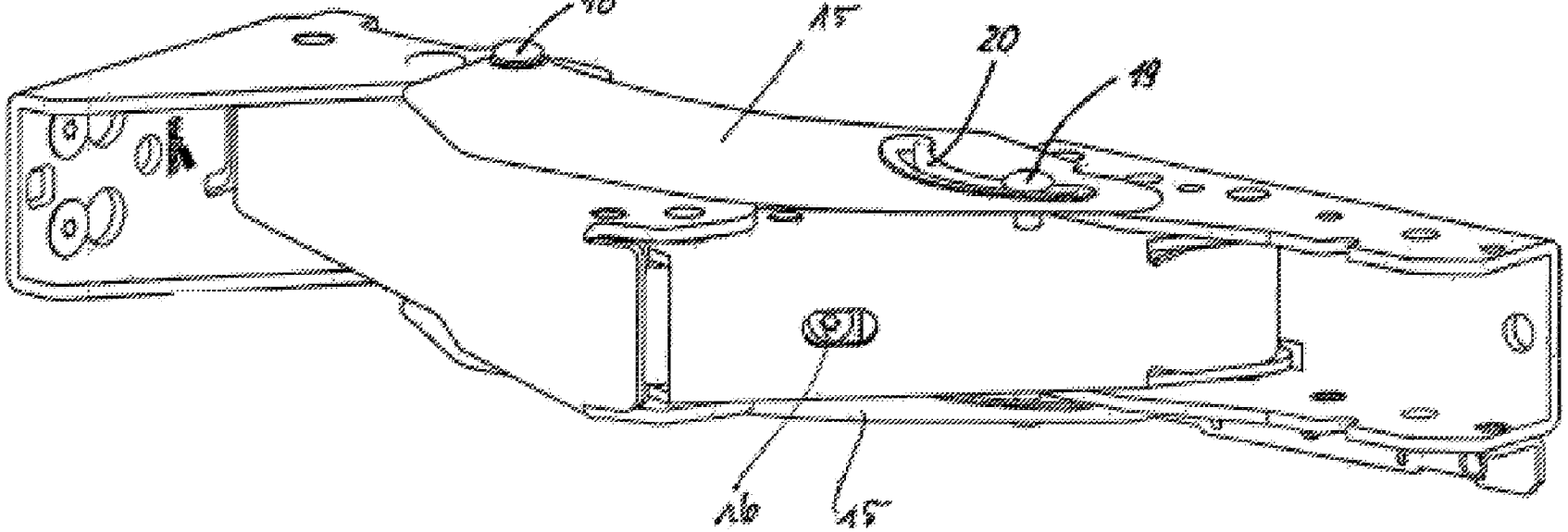

FIG. 3 a perspective illustration of another exemplary embodiment of the invention.

Figure 4:
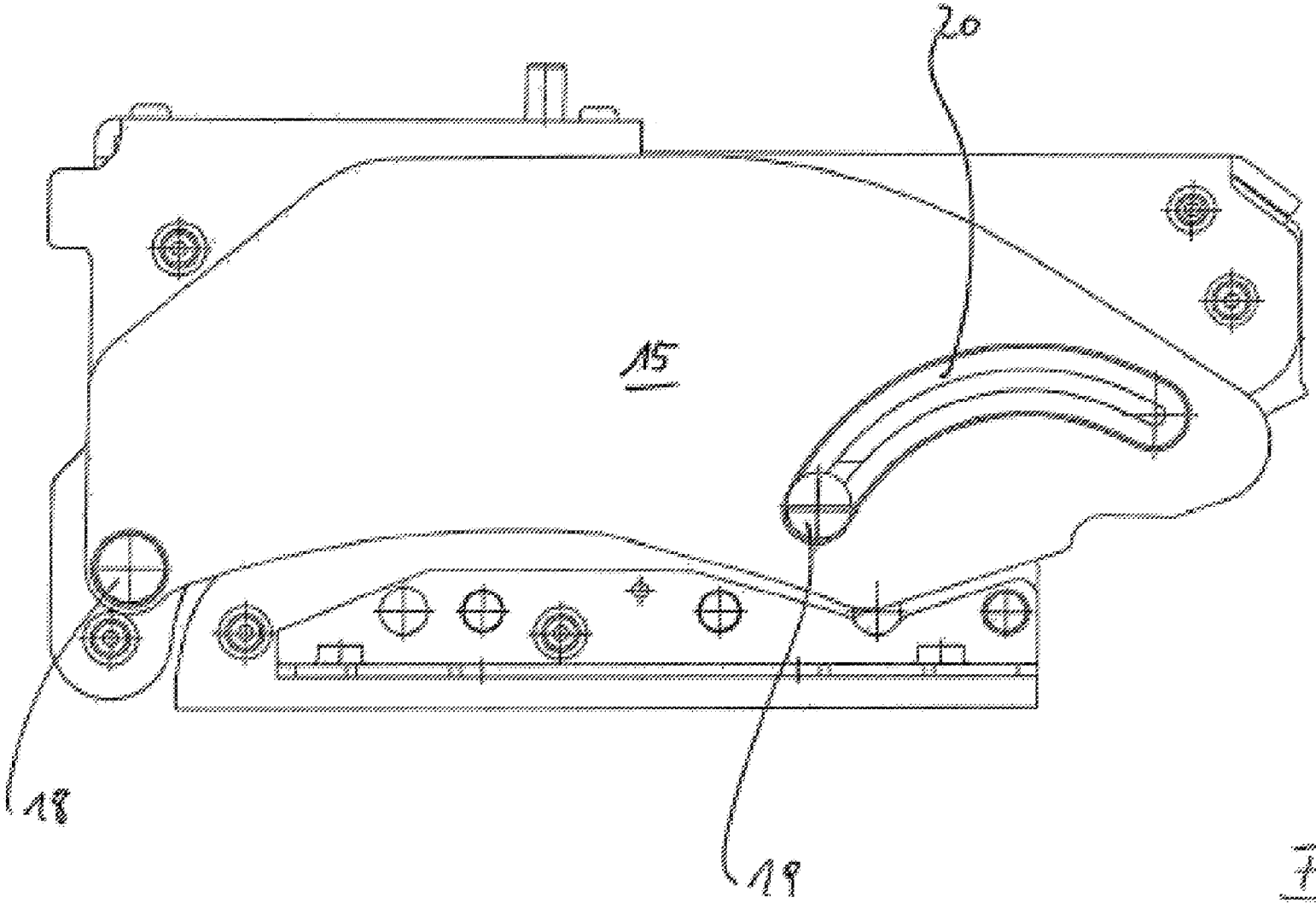

FIG. 4 a lateral view of the multilink hinge according to FIG. 3.

As FIG. 1 shows, the hinge is comprised essentially of two mounting parts 1, 2, one of which is attached to the body (not shown). As is clearly visible in FIG. 2, the mounting parts 1, 2 are mechanically connected to one another via levers. In the exemplary embodiment shown, two articulated levers 4, 5 are pivotably connected to the mounting section 1, spaced somewhat from one another, via articulated joints 7, 8. At their free ends, the articulated levers 4, 5 are attached via articulated joints 9, 10 to a hinge arm 3, which is in turn connected at its free end to the mounting part 2 via articulated joints 11, 12. The articulated lever 4 has an articulated joint 21 in the vicinity of its center, which joint is connected to an articulated lever 6. The articulated lever 6 is pivotably attached at its free end to the mounting part 2 via the articulated joint 12.

As is apparent from FIG. 2, the articulated lever 5 is connected to a radial cam 13 in the vicinity of the articulated joint 10, said cam being formed on a cam body 22 that is fastened to the hinge arm 3; the contouring of said cam body may deviate from the shape shown in FIG. 2 for the purpose of achieving different mechanical behavior.

Adjacent to the articulated joint 10, a rocker arm 14 is pivotably mounted at a rotational point 23. In the exemplary embodiment shown, the rocker arm is being forced in a counterclockwise direction by a spring 17. A pressure roller 24 is disposed on the rocker arm and is in contact with the radial cam.

As is evident from FIG. 1, the rocker arm is equipped with an adjusting screw 16. The head of the adjusting screw 16 can be accessed via an opening 25 in the articulated lever 5 for a screwdriver or a similar tool. If the screw is unscrewed farther out of the rocker arm, the head of the screw will strike the articulated lever 5 and limit the rotation of the rocker arm 14, thereby altering the characteristics of the spring behavior. With the adjusting screw, the rocker arm can also be rotated until the spring action is nullified.

In FIGS. 3 and 4 a further exemplary embodiment is shown. A protective plate 15 is positioned on the sides of the hinge. Said plate is pivotably fastened at one end to the mounting part 2 via an articulated joint 18, and at its opposite end it is equipped with a longitudinal opening 20, which controls the guidance on a pilot pin 19. In the exemplary embodiment shown, this pilot pin is formed on the articulated lever 5, however it may also be formed on other components based upon the kinematics of the hinge.

The articulated joint 18 and/or the pilot pin 19 is/are advantageously formed by an extension of the joint pins that join the articulated levers to one another in an articulated fashion.

Depending upon the configuration or the use of the hinge, this protective plate 15 can be arranged on only one side or on both sides of the hinge. If two protective plates are used, it is also within the scope of the invention to connect these to one another in a U-shape that extends beyond the hinge.

The invention claimed is:

1. A hinge, comprising:

a first mounting part defining a first end and a second end;

a second mounting part defining a third end and a fourth end;

a first articulated lever defining a fifth end and a sixth end;

a second articulated lever defining a seventh end and an eighth end;

a third articulated lever defining a ninth end and a tenth end;

a fourth articulated lever defining an eleventh end and a twelfth end;

wherein the fifth end pivotally connects between the first end and the second end, wherein the sixth end pivotally connects to the tenth end, wherein the ninth end pivotally connects to the fourth end, wherein the third end pivotally connects to the eleventh end, wherein the second end pivotally connects to the seventh end, wherein the eighth end pivotally connects between the ninth end and the tenth end, and wherein the twelfth end pivotally connects between the seventh end and the eighth end;

at least one protective plate covering at least a portion of at least one of the first mounting plate, the second mounting plate, the first articulated lever, the second articulated lever, the third articulated lever, and the fourth articulated lever;

the protective plate pivotally connects at a thirteenth end to the second mounting part adjacent to the third end, between the third end and the fourth end, the protective plate pivotally connects at a fourteenth end to a pilot pin, the fourteenth end defines a longitudinal opening, and the pilot pin is slidably disposed within the longitudinal opening.

2. The hinge of claim 1, wherein the hinge is adapted to be disposed on a refrigerator for mounting a door thereto.

* * * * *